US010076911B2

(12) United States Patent
Murphy et al.

(10) Patent No.: US 10,076,911 B2
(45) Date of Patent: Sep. 18, 2018

(54) FLUID CARTRIDGE

(71) Applicant: Hewlett-Packard Development Company, L.P., Houston, TX (US)

(72) Inventors: Bryan Murphy, Lucan (IE); Patrick Lynch, Lucan (IE); John McNeilly, Dublin (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/684,392

(22) Filed: Aug. 23, 2017

(65) Prior Publication Data

US 2017/0348975 A1 Dec. 7, 2017

Related U.S. Application Data

(63) Continuation of application No. 14/900,957, filed as application No. PCT/US2013/048437 on Jun. 28, 2013, now abandoned.

(51) Int. Cl.
*B41J 2/165* (2006.01)
*B41J 2/175* (2006.01)

(52) U.S. Cl.
CPC ..... *B41J 2/17526* (2013.01); *B41J 2/1752* (2013.01); *B41J 2/1755* (2013.01); *B41J 2/17523* (2013.01); *B41J 2/17553* (2013.01)

(58) Field of Classification Search
None
See application file for complete search history.

(56) References Cited

U.S. PATENT DOCUMENTS

| | | | |
|---|---|---|---|
| 5,212,502 | A | 5/1993 | Bowling |
| 6,113,228 | A | 9/2000 | Pawlowski, Jr. |
| 6,168,262 | B1 | 1/2001 | Clark et al. |
| 6,174,046 | B1 | 1/2001 | Reid et al. |

(Continued)

FOREIGN PATENT DOCUMENTS

| | | |
|---|---|---|
| CN | 1259091 | 7/2000 |
| CN | 1502472 | 6/2004 |

(Continued)

OTHER PUBLICATIONS

PCT International Search Report and Written Opinion, dated Jan. 30, 2014, PCT Application No. PCT/US2013/048437, European Patent Office, 18 pp.

*Primary Examiner* — Alejandro Valencia
(74) *Attorney, Agent, or Firm* — Dierker & Kavanaugh PC

(57) ABSTRACT

In one example, a group of printing fluid cartridges in which each cartridge includes: a reservoir; a printing fluid outlet from the reservoir; multiple electrical contacts arranged next to one another across the cartridge with an interface along the cartridge between each pair of adjacent electrical contacts; and multiple guideways next to the electrical contacts lengthwise and configured to align the cartridge to a receiver when the cartridge is installed in the receiver. Each of the guideways spans exactly one of the interfaces widthwise and is configured to simultaneously align the electrical contacts to corresponding electrical contacts on a receiver and to discriminate the cartridge from other printing fluid cartridges to prevent the cartridge from being inserted incorrectly into a receiver.

9 Claims, 9 Drawing Sheets

(56) References Cited

U.S. PATENT DOCUMENTS

| | | | | |
|---|---|---|---|---|
| 6,286,949 | B1 * | 9/2001 | Lewis | B41J 2/17509 347/86 |
| 6,416,166 | B1 | 7/2002 | Robinson et al. | |
| 6,431,684 | B1 | 8/2002 | Olsen | |
| 6,435,662 | B2 | 8/2002 | Kline et al. | |
| 6,471,333 | B1 | 10/2002 | Powell et al. | |
| 6,554,411 | B1 | 4/2003 | Hatasa et al. | |
| 6,568,793 | B2 | 5/2003 | Santhanam et al. | |
| 6,793,329 | B2 | 9/2004 | Battey et al. | |
| 6,837,565 | B2 | 1/2005 | Studholme et al. | |
| 6,942,328 | B2 | 9/2005 | Haldorsen | |
| 6,959,985 | B2 | 11/2005 | Steinmetz | |
| 6,979,079 | B2 * | 12/2005 | Hashii | B41J 2/17503 347/84 |
| 7,025,440 | B2 | 4/2006 | Graf et al. | |
| 7,040,744 | B2 | 5/2006 | Shinada | |
| 7,156,491 | B2 | 1/2007 | Sturgeon et al. | |
| 7,278,721 | B2 | 10/2007 | Shimizu | |
| 7,703,902 | B2 | 4/2010 | Nozawa | |
| 8,023,836 | B2 | 9/2011 | Dawson | |
| 8,075,117 | B2 | 12/2011 | Steinmetz et al. | |
| 2005/0024452 | A1 | 2/2005 | Steinmetz | |
| 2006/0017776 | A1 | 1/2006 | Morton et al. | |
| 2007/0263044 | A1 | 11/2007 | Nip | |
| 2008/0180495 | A1 | 7/2008 | Gonzales | |

FOREIGN PATENT DOCUMENTS

| | | |
|---|---|---|
| CN | 1856405 | 11/2006 |
| CN | 101024342 | 8/2007 |
| CN | 102896905 | 1/2013 |
| EP | 0878307 | 11/1998 |
| EP | 0940258 | 9/1999 |
| EP | 1232869 | 8/2002 |
| EP | 1504907 | 2/2005 |
| EP | 1772270 | 4/2007 |
| EP | 1772272 | 4/2007 |
| KR | 20010013265 | 2/2001 |

* cited by examiner

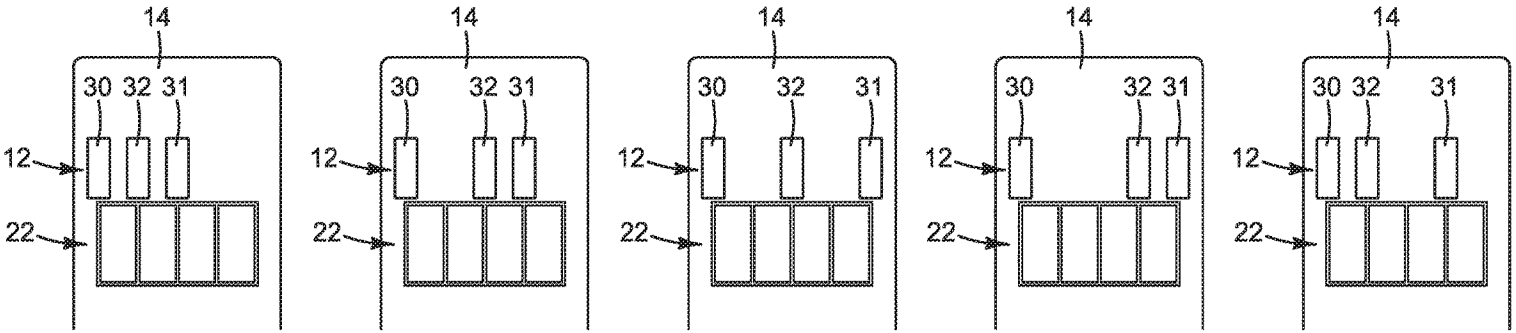
FIG. 11A
FIG. 11B
FIG. 11C
FIG. 11D
FIG. 11E
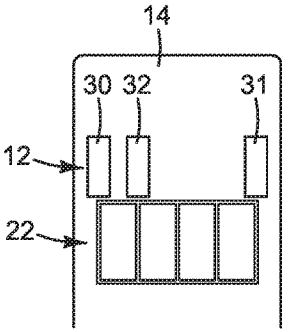
FIG. 11F
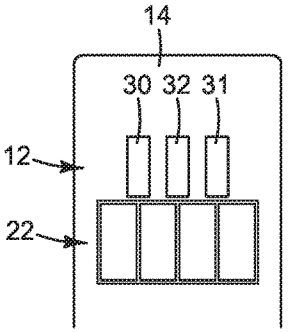
FIG. 11G
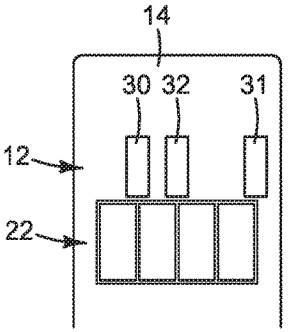
FIG. 11H
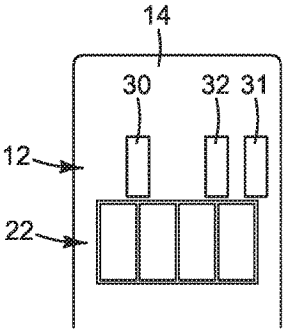
FIG. 11I
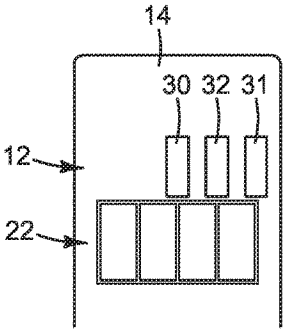
FIG. 11J

FLUID CARTRIDGE

CROSS REFERENCE TO RELATED APPLICATIONS

This is a continuation of application Ser. No. 14/900,957 filed Dec. 22, 2015, which is itself a 35 U.S.C. 371 national stage filing of international application serial no. PCT/US2013/048437 filed Jun. 28, 2013, each incorporated herein by reference in its entirety.

BACKGROUND

Replaceable ink cartridges for inkjet printers must be accurately aligned when inserted into a carriage or other receiver on the printer so that electrical contacts on each cartridge properly engage the corresponding contacts on the receiver. Cartridges may also be keyed to discriminate one cartridge from another to prevent a cartridge from being inserted incorrectly into the receiver.

DRAWINGS

FIGS. 11A-11J show possible keying positions for a three-guideway cartridge alignment structure.

The same part numbers designate the same or similar parts throughout the figures.

DESCRIPTION

A new alignment structure has been developed for a printing fluid cartridge to accurately align the cartridge with the receiver. The alignment structure can also be used to discriminate one cartridge from another to prevent a cartridge from being inserted incorrectly into a receiver. Some ink and other such printing fluid cartridges include an electronic chip that contains information about the cartridge and/or the fluid contained in the cartridge. Electrical contacts on the chip connect to mating contacts on the printer. The accuracy of the alignment between the electrical contacts on the cartridge and the electrical contacts on the printer when the cartridge is installed in the printer depends on the precision with which the chip is assembled to the body of the cartridge as well as the precision with which the cartridge is aligned to the printer during installation. In one example, the new cartridge alignment structure is designed such that it may be used both to align the chip to the body of the cartridge during manufacturing and to align the cartridge to the printer when the cartridge is installed in the printer. This alignment structure, therefore, provides a single, common reference to more precisely align the electrical contacts on the chip to the electrical contacts on the printer. More precise alignment enables the use of smaller contacts, reducing the size and cost of the chip.

In one example, an alignment structure for a fluid cartridge includes multiple slots in the cartridge housing spaced apart from one another across a width of the housing to align the cartridge to a receiver when the cartridge is installed in the receiver. The slots may be configured to simultaneously align the cartridge to the receiver as well as discriminate the cartridge from other fluid cartridges to prevent the cartridge from being inserted incorrectly into a receiver, for example by varying the spacing between the slots on different cartridges. In one specific implementation for a printing fluid cartridge with electrical contacts, the slots are positioned adjacent to the electrical contacts with each slot spanning an interface between two of the electrical contacts. These and other examples shown in the figures and described below illustrate but do not limit the invention, which is defined in the Claims following this Description.

Figure 1:
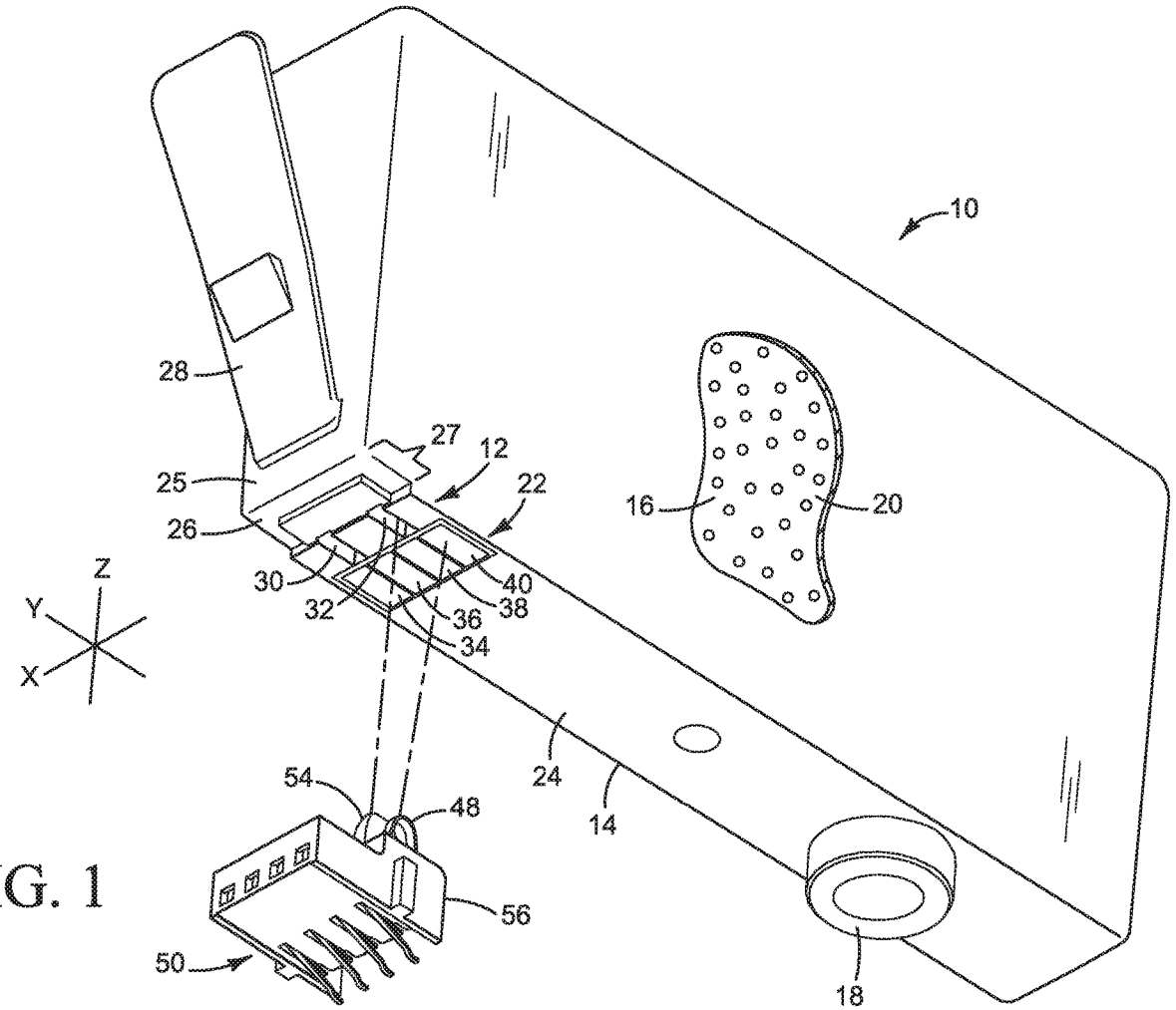
FIG. 1 illustrates a fluid cartridge implementing one example of a new alignment structure.
Figure 2:
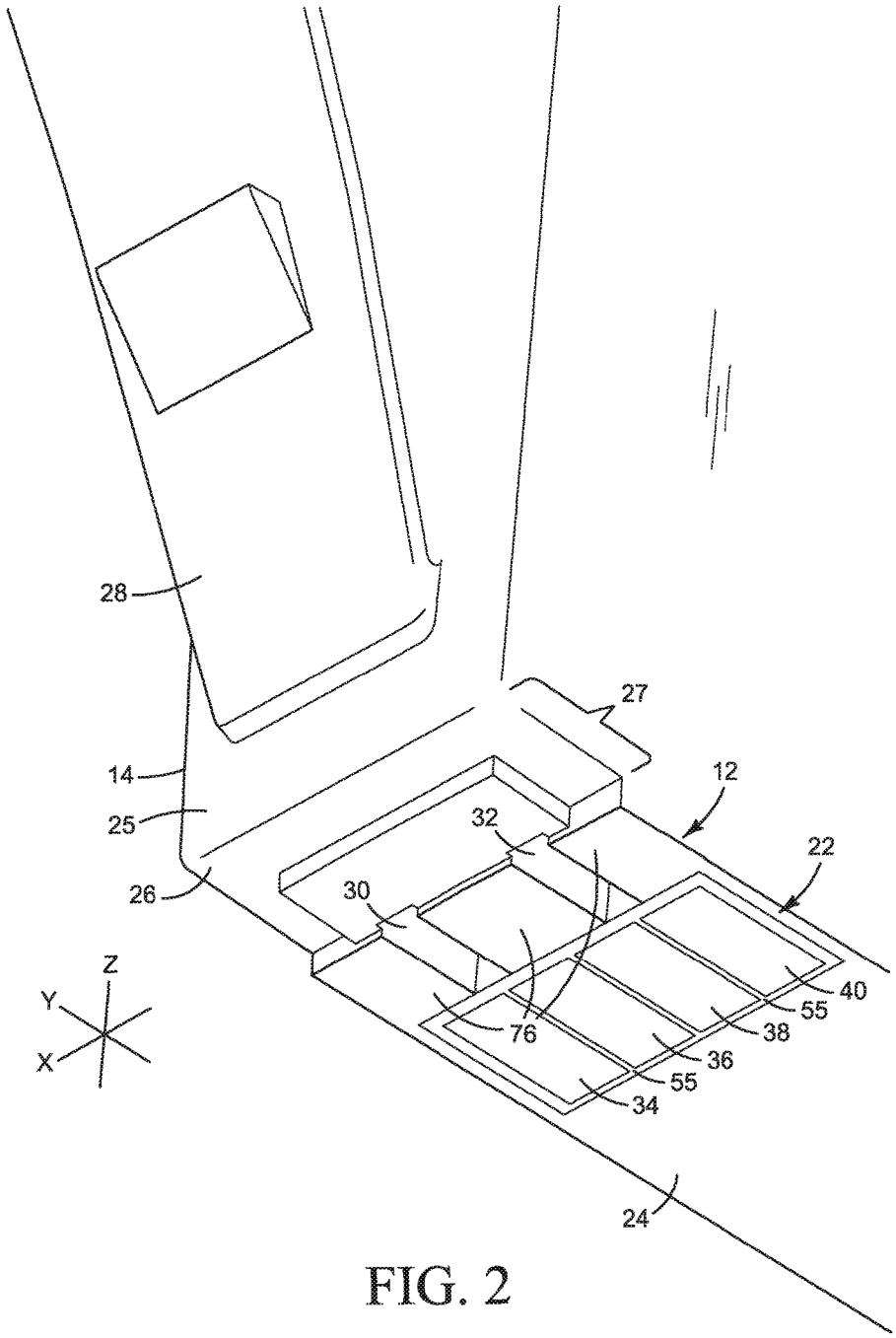
FIGS. 2-4 are detail views from FIG. 1.
Figure 3:
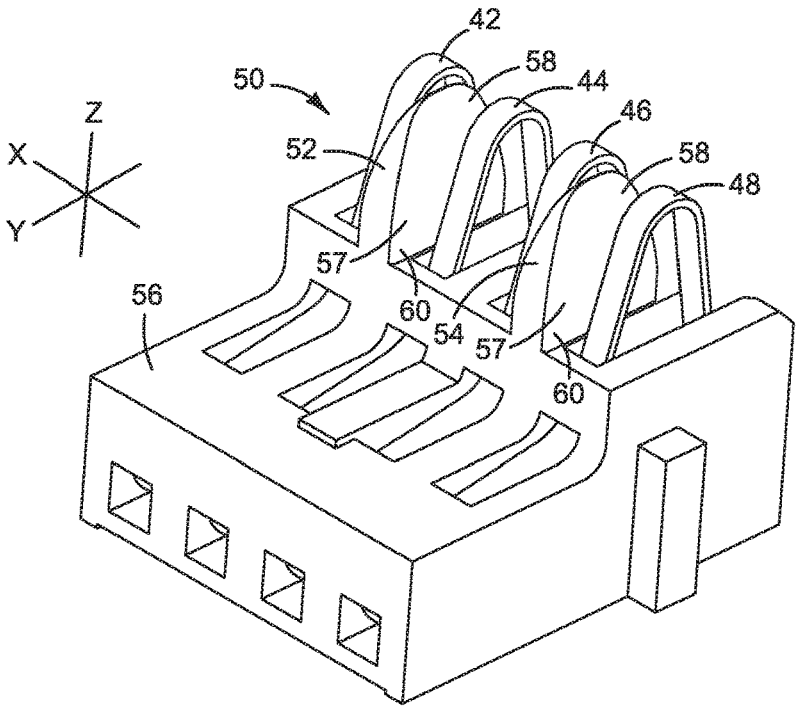
Figure 4:
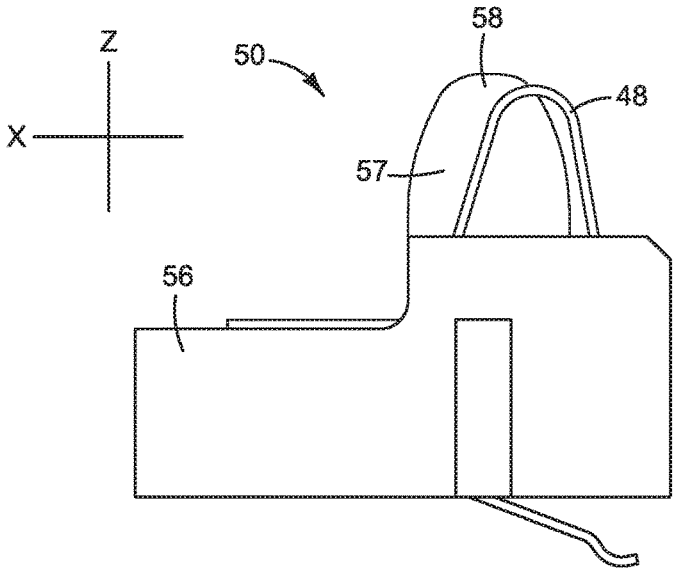
Figure 5:
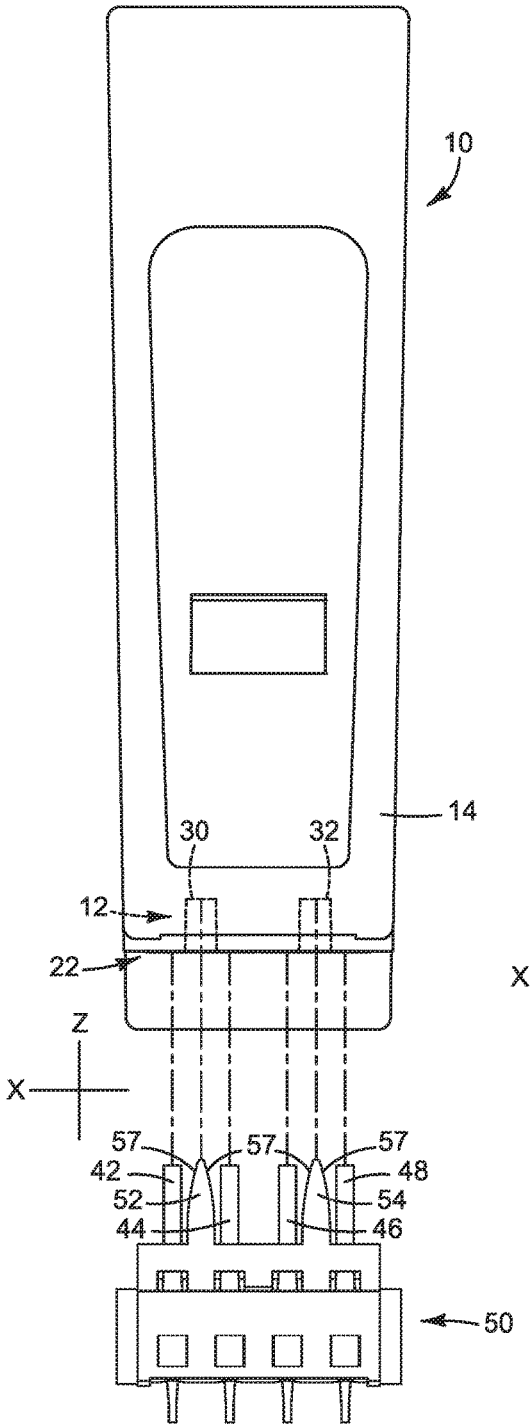
FIGS. 5, 6 and 7, 8 are front and side elevation views, respectively, showing the installation of the fluid cartridge of FIG. 1 into a receiver.

Referring now to the figures, FIG. 1 illustrates a fluid cartridge 10 implementing one example of an alignment structure 12 and FIGS. 2-4 are detail views from FIG. 1. Fluid cartridge 10 represents, for example, a replaceable ink supply container for an inkjet printer. Referring to FIG. 1, cartridge 10 includes a housing 14 with a reservoir 16 for holding a fluid and an outlet 18 from reservoir 16 through which fluid may flow to the receiving device. In the case of an ink cartridge 10, ink in reservoir 16 usually is held in a foam block or other absorbent material 20 to help control the release of ink through outlet 18. Cartridge 10 also includes an electronic chip 22 affixed to housing 14. In the example shown, chip 22 is affixed to the bottom 24, rearward portion 26 of housing 14. Cartridge 10 may also include a latch 28 for holding the cartridge in a receiving device (a printer, for example) and releasing the cartridge from the receiving device.

Referring now also to the detail views of FIGS. 2-4, alignment structure 12 includes two guideways 30, 32 adjacent to electrical contacts 34, 36, 38, 40 on chip 22. Planar electrical contacts for an electronic chip such as contacts 34-40 shown in FIGS. 2-4 are commonly referred to as contact pads. In the example shown, chip 22 includes four contact pads 34-40 that engage four mating electrical contacts 42, 44, 46, 48 on a receiver 50 to electrically connect chip 22 to receiver 50 and, thus, to the printer or other device receiving cartridge 10. More or fewer chip contact pads and/or receiver contacts are possible.

Guideways 30, 32 on cartridge 10 fit over a pair of guides 52, 54 on receiver 50. Guideways 30, 32 are positioned on cartridge 10 relative to contact pads 34-40 and guides 52, 54 are positioned on receiver 50 relative to electrical contacts 42-48 so that contacts pads 34-40 will be correctly aligned to contacts 42-48 when guideways 30, 32 are installed over guides 52, 54. For example, as shown in the figures, each guide 52, 54 is centered between electrical contacts 42/44 and 46/48 and each guideway 30, 32, therefore, is centered along an interface 55 (FIG. 2) between contact pads 34/36 and 38/40.

Figure 6:
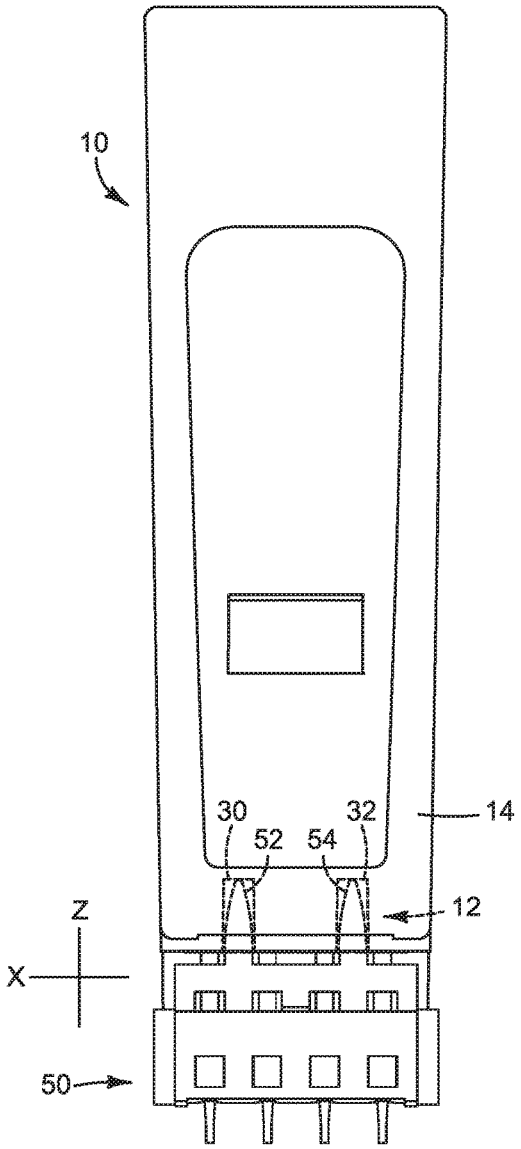

In the example shown, guideways 30, 32 are formed as slots in the bottom 24 of housing 14 and guides 52, 54 are formed as tapered prongs on receiver body 56. The slots 30, 32 are located between the rear face 25 of housing 14 and contact pads 34-40 such that there is a gap 27 between the rear of slots 30, 32 and the rear face 25 of the housing 14. As been seen in the installation sequence shown in FIGS. 5, 7 and 6, 8, each receiver prong 52, 54 has curved guide surfaces 57 tapered along both sides in the X and Y directions from a narrower part 58 away from receiver body 56 to a broader part 60 near receiver body 56 where it is the same shape as the rectangular opening 62 to each of the corresponding slots 30, 32. Accordingly, as the forward part 26 of fluid cartridge 10 is pushed down on to receiver 50 in the Z direction, as best seen by comparing FIGS. 5, 7 and 6, 8, prongs 52, 54 sliding into slots 30, 32 guide the forward part of cartridge 10 and contact pads 34-40 into alignment in the X and Y directions with respect to receiver 50 and contacts 42-48. Curved and tapered guide surfaces 57 help the alignment to begin early in the downward motion of cartridge 10 and give a smooth transition into the fully aligned position shown in FIGS. 6 and 8.

Also in the example shown, each slot 30, 32 is tapered on one side along a curved guide surface 61 in only the Y direction from a narrower internal part 63 to the broader rectangular external part 62. A curved guide surface 61 helps limit the intrusion of slots 30, 32 into reservoir 16 to minimize capacity loss although, as in this slot configuration, molding constraints may make it desirable to include some straight slot surfaces. The close proximity of slots 30, 32 to contact pads 34-40 and prongs 52, 54 to contacts 42-48 helps increase the accuracy of the alignment of pads 34-40 to contacts 42-48.

Figure 9:
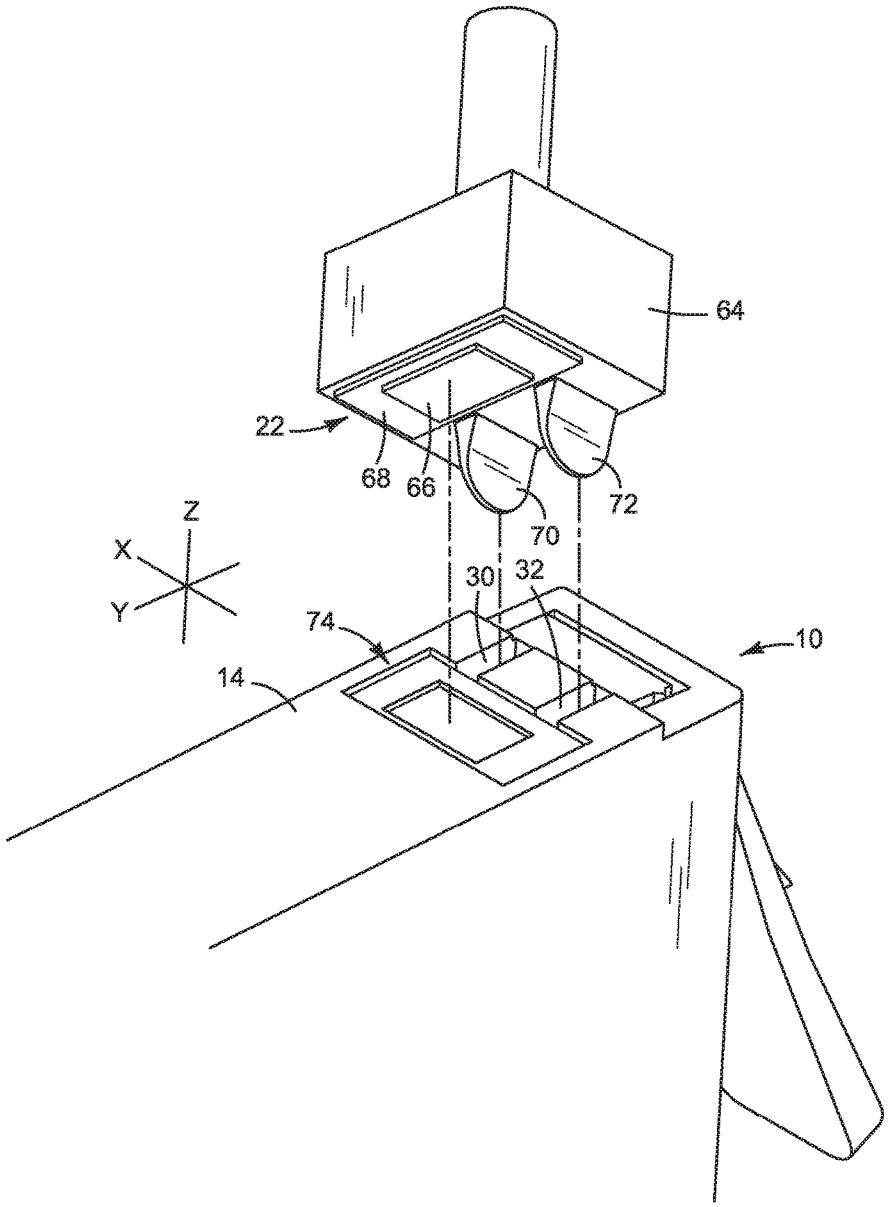
FIG. 9 illustrates one example of a tool for placing an electronic chip on a fluid cartridge using the alignment structure shown in FIG. 1.
Figure 10A:
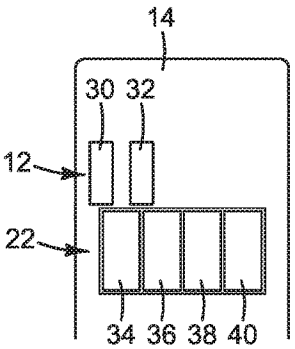
FIGS. 10A-10J show possible keying positions for a two-guideway cartridge alignment structure such as that shown in FIG. 1.
Figure 10B:
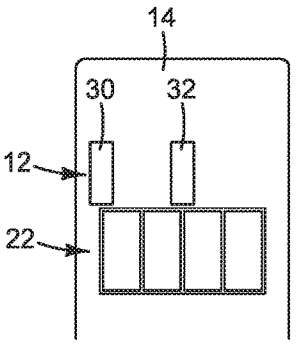
Figure 10C:
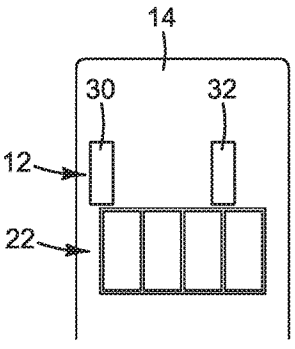
Figure 10D:
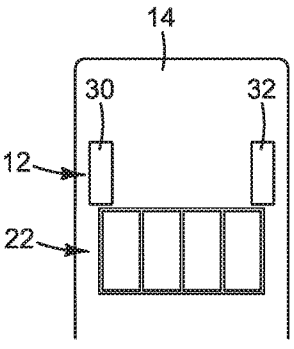
Figure 10E:
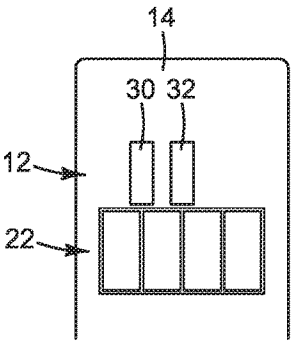
Figure 10F:
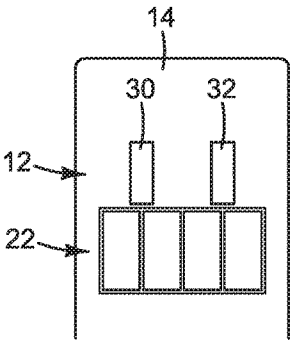
Figure 10G:
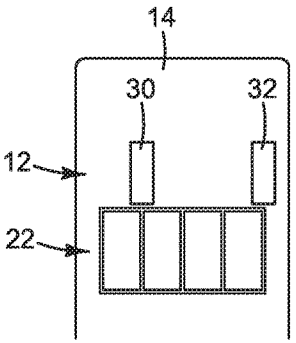
Figure 10H:
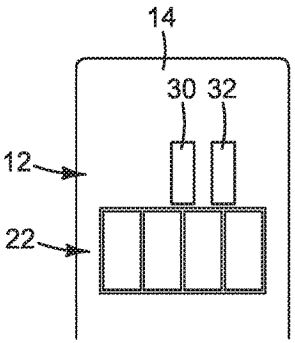
Figure 10I:
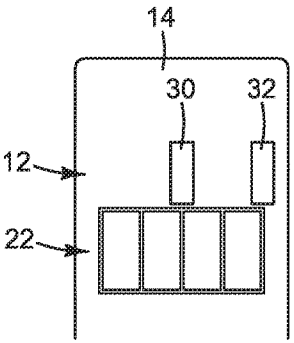
Figure 10J:
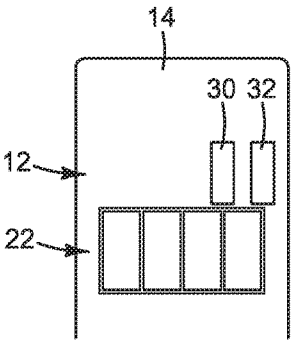

FIG. 9 illustrates a placement tool 64 for placing an electronic chip 22 on cartridge housing 14. Referring to FIG. 9, chip 22 is an assembly or "package" that includes an integrated circuit die 66 mounted to a printed circuit board or other suitable substrate 68 with electrical contact pads 34-40 (seen in FIG. 2). Contact pads 34-40 are on the backside of substrate 68 and not visible in FIG. 9. A pair of guides 70, 72 on placement tool 64 align with guideways 30, 32 on cartridge 10. Chip 22 fits into a recess 74 in cartridge housing 14 immediately adjacent to guideways 70, 72. As noted above, guideways 30, 32 are positioned to align along the interface between contact pads 34/36 and 38/40 (FIG. 2) when chip 22 is installed in recess 74. The size, shape and position of guides 70, 72 on tool 64, tapered prongs 70, 72 in this example, are made to match guides 52, 54 on receiver 56 to help guide chip 22 into the correct position on cartridge 10. The use of the same alignment structures for placing chip 22 on cartridge 10 and for aligning cartridge 10 to receiver 50 effectively provides a single, common reference to more precisely align contact pads 34-40 on cartridge 10 to electrical contacts 44-48 on receiver 50. More precise electrical contact alignment enables the use of smaller contact pads 34-40, allowing a reduction in the size and cost of chip 22.

Alignment structure 12 can also be used as a keying feature to discriminate between different cartridges 10, for example between cartridges containing different color ink. Varying the position of two guideways 30, 32 across five possible pad/contact pair positions as shown in FIGS. 10A-10J gives ten discriminating permutations. In this example, only the guideway configuration shown in FIG. 10F will fit the receiver 50 shown in FIG. 3. More or fewer keying combinations are possible using more or fewer cartridge guideways, more or fewer guides, and/or more or fewer available positions. Also, the number of guideways need not match the number of guides. For example, as shown in FIGS. 11A-11J, three guideways 30, 31, 32 on cartridge 10 may be used with a two guided receiver, enabling two different cartridges to fit on the same receiver. In this example, the guideway configurations shown in FIGS. 11E, 11G and 11I will fit the two guide receiver 50 shown in FIG. 3.

Figure 8:
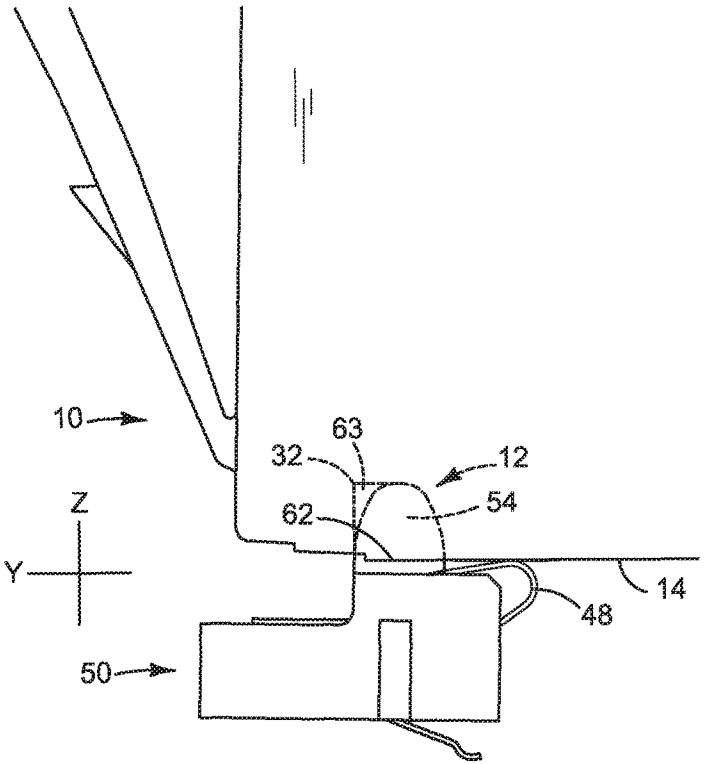
Figure 7:
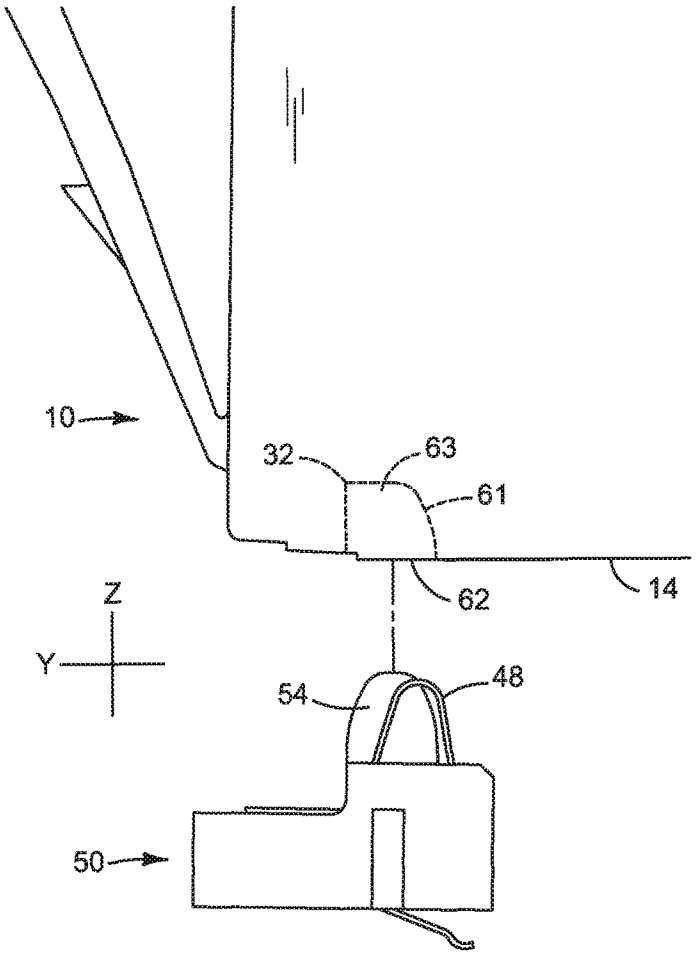

For the configuration of receiver 50 shown in the figures, in which each electrical contact 42-48 initially engages cartridge 10 on the housing 14 in front of contact pads 34-40, and then slides back to engage the contact pads 34-40, as best seen by comparing FIGS. 7 and 8, a sufficient area 76 (FIG. 2) on the face of housing 14 must be allowed next to the guideways 30, 32 to meet the initial engagement of receiver contacts 42-48. Thus, for this contact configuration, the width of each area 76 adjacent to guideways 30, 32 on cartridge housing 14 should approximate (or exceed) the width of the corresponding contact 42-48 on receiver 50.

Figure 12:
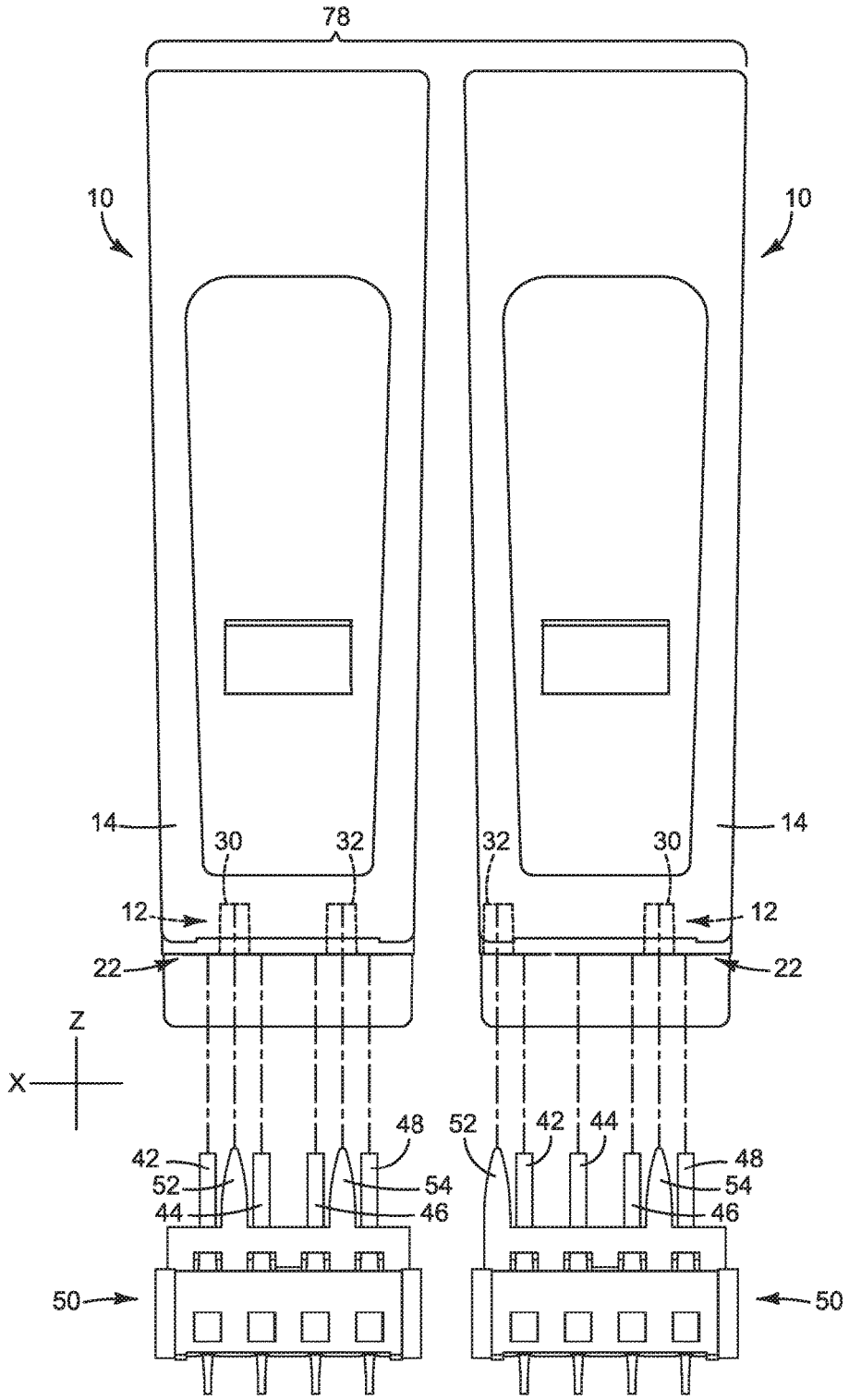
FIG. 12 illustrates one example of a group of fluid cartridges each with a different arrangement of guideways for aligning the cartridge to a receiver and for discriminating between cartridges in the group.

FIG. 12 illustrates one example of a group 78 of fluid cartridges 10, 11 each with a different arrangement of guideways 30, 32 for aligning the cartridge to a receiver 50 and for discriminating between cartridges 10 and 11 in group 78. A "group" of cartridges as used in this document means a number of individual cartridges with a unifying relationship. For example, a color inkjet printer often will have two or more replaceable ink cartridges each containing a different color ink (or different colors of ink if a cartridge includes more than one color). The cartridges in such a color group may be identical in construction apart from alignment feature 12 in which the position of guideways 30, 32 is varied to discriminate between cartridges 10, 11 in group 78. The position of guides 52, 54 on each receiver 50, 51 are similarly varied to accept the corresponding cartridge 10, 11. The cartridges in a color group for an inkjet printer may be available as a group, for example for a new printer, and/or individually, for example when a single cartridge is replaced.

As noted at the beginning of this description, the examples shown in the figures and described above illustrate but do not limit the invention. Other forms, details, and examples may be made and implemented. Therefore, the foregoing description should not be construed to limit the scope of the invention, which is defined in the following claims.

The invention claimed is:

1. A printing fluid cartridge, comprising:

a cuboid housing containing a reservoir to hold a printing fluid, the housing having a front face along a first narrow side of the housing, a rear face along a second narrow side of the housing opposite the first side, and a bottom face along a third narrow side of the housing;

an outlet from the reservoir on the bottom face of the housing;

multiple electrical contacts on the bottom face of the housing rearward of the outlet, the electrical contacts arranged next to one another across a width of the bottom face of the housing with an interface along the bottom face of the housing between each pair or adjacent contacts; and multiple slots in the bottom face of the housing next to the electrical contacts opposite the outlet such that the electrical contacts are between the slots and the outlet, the slots spaced apart from one another across the width of the bottom face of the housing with each slot oriented lengthwise in line with an edge of one or more of the electrical contacts and the slots located between the rear face of the housing and the electrical contacts such that there is a gap between the rear of the slots and the rear face of the housing, each slot including a tapered guide surface to engage and guide the rear of the cartridge along a surface on a receiver when the cartridge is installed in the receiver, the tapered guide surface tapered on only one side along a curved guide surface in the Y direction from a narrower internal part to the broader rectangular external part.

2. The cartridge of claim 1, where the slots are configured together to simultaneously:

align the electrical contacts to corresponding electrical contacts on a receiver; and discriminate the cartridge from other printing fluid cartridges to prevent the cartridge from being inserted incorrectly into a receiver.

3. The cartridge of claim 1, where at least one of the slots spans exactly one of the interfaces widthwise.

4. The cartridge of claim 3, wherein each of the slots spans exactly one of the interfaces widthwise.

5. A group of printing fluid cartridges in which each cartridge comprises:

a cuboid housing containing a reservoir to hold a printing fluid, the housing having a front face along a first narrow side of the housing, a rear face along a second narrow side of the housing opposite the first side, and a bottom face along a third narrow side of the housing;

an outlet from the reservoir on the bottom face of the housing;

multiple electrical contacts on the bottom face of the housing rearward of the outlet, the electrical contacts arranged next to one another across a width of the bottom face of the housing with an interface along the bottom face of the housing between each pair or adjacent contacts; and multiple slots in the bottom face of the housing to engage corresponding prong on a receiver, the slots positioned next to the electrical contacts opposite the outlet such that the electrical contacts are between the slots and the outlet, the slots spaced apart from one another across the width of the bottom face of the housing in an arrangement different from the arrangement of slots in the other cartridge(s) in the group, with each slot oriented lengthwise in line with an edge of one or more of the electrical contacts and the slots located between the rear face of the housing and the electrical contacts such that there is a gap between the rear of the slots and the rear face of the housing, each slot including a tapered guide surface to engage and guide the rear of the cartridge along a surface on a receiver when the cartridge is installed in the receiver, the tapered guide surface tapered on only one side along a curved guide surface in the Y direction from a narrower internal part to the broader rectangular external part.

6. The group of claim 5, where each cartridge in the group includes the same number of slots and the slots are spaced apart differently from the spacing of slots in the other cartridge(s) in the group.

7. The group of claim 6, where each cartridge includes exactly four electrical contacts and each cartridge includes exactly two slots or exactly three slots.

8. The group of claim 7, where at least one of the slots in each cartridge spans exactly one interface between adjacent electrical contacts.

9. The group of claim 8, where each slot includes a tapered guide surface to engage and guide the cartridge along a surface on a receiver when the cartridge is installed in the receiver.

* * * * *